US008827777B2

(12) United States Patent
Göpel et al.

(10) Patent No.: US 8,827,777 B2
(45) Date of Patent: Sep. 9, 2014

(54) METHOD FOR OPERATING A COIN DISPENSING DEVICE AND A COIN DISPENSING DEVICE

(75) Inventors: Stig Göpel, Osten (DE); Thorsten Schneider, Apensen (DE)

(73) Assignee: National Rejectors, Inc. GmbH, Buxtehude (DE)

( * ) Notice: Subject to any disclaimer, the term of this patent is extended or adjusted under 35 U.S.C. 154(b) by 874 days.

(21) Appl. No.: 11/753,365

(22) Filed: May 24, 2007

(65) Prior Publication Data

US 2008/0293347 A1 Nov. 27, 2008

(51) Int. Cl.
*G07D 9/06* (2006.01)
*G07D 1/00* (2006.01)

(52) U.S. Cl.
CPC ..... *G07D 1/00* (2013.01)
USPC ..... 453/61; 453/16; 453/24; 453/44

(58) Field of Classification Search
USPC ..... 453/16, 17, 24–31, 36–48, 50–54, 453/58–63
See application file for complete search history.

(56) References Cited

U.S. PATENT DOCUMENTS

| | | | | |
|---|---|---|---|---|
| 3,690,332 | A * | 9/1972 | Dykehouse et al. | 453/21 |
| 4,044,877 | A * | 8/1977 | Burton | 194/200 |
| 4,339,071 | A * | 7/1982 | Hall | 232/5 |
| 4,367,760 | A * | 1/1983 | Thomas et al. | 453/41 |
| 5,112,275 | A * | 5/1992 | Sato | 453/5 |
| 5,542,519 | A * | 8/1996 | Weston et al. | 194/217 |
| 5,566,807 | A * | 10/1996 | Morun | 194/217 |
| 5,595,535 | A | 1/1997 | Wenskus | 453/40 |
| 6,045,443 | A * | 4/2000 | Weston et al. | 453/17 |
| 6,267,662 | B1 * | 7/2001 | Jard et al. | 453/17 |
| 6,422,373 | B1 * | 7/2002 | Yellop et al. | 194/217 |
| 6,564,965 | B2 * | 5/2003 | Cost | 221/133 |
| 6,615,970 | B1 * | 9/2003 | Billington et al. | 194/216 |
| 6,994,202 | B1 * | 2/2006 | Billington et al. | 194/217 |
| 7,014,554 | B1 * | 3/2006 | Fletcher et al. | 453/20 |
| 7,048,108 | B1 * | 5/2006 | Yellop et al. | 194/317 |
| 2003/0201146 | A1 * | 10/2003 | Abe et al. | 194/302 |
| 2004/0035672 | A1 * | 2/2004 | Fletcher et al. | 194/206 |
| 2004/0093117 | A1 * | 5/2004 | Daout et al. | 700/231 |
| 2004/0226802 | A1 | 11/2004 | Schneider | 194/335 |
| 2005/0142998 | A1 * | 6/2005 | Enomoto et al. | 453/9 |

FOREIGN PATENT DOCUMENTS

| | | | |
|---|---|---|---|
| DE | 103 22 105 | A1 | 12/2004 |
| DE | 103 22 384 | A1 | 12/2004 |
| DE | 10 2004 034 149 | A1 | 2/2006 |
| EP | 0 680 021 | B1 | 9/1997 |
| WO | 95/14290 | | 5/1995 |

* cited by examiner

*Primary Examiner* — Jeffrey Shapiro
(74) *Attorney, Agent, or Firm* — Vidas, Arrett & Steinkraus

(57) ABSTRACT

A method for operating a coin dispensing device, the coin dispensing device having a plurality of coin dispensing modules, wherein at least one coin tube for holding coins of a predetermined nominal value is assigned to each dispensing module, each dispensing module being adapted to dispense a coin held in the coin tube assigned to the dispensing module in a dispensing cycle and in response to a control signal, wherein at least two coin tubes assigned to different dispensing modules contain coins of the same nominal value and in one dispensing cycle, a plurality of coin dispensing modules are being activated.

15 Claims, 2 Drawing Sheets

METHOD FOR OPERATING A COIN DISPENSING DEVICE AND A COIN DISPENSING DEVICE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a method for operating a coin dispensing device and to a coin dispensing device that can carry out the method.

Coin dispensing devices are used in vending machines, gambling machines, money changers and other types of machines able to dispense coins according to a predetermined amount of money. In general, these types of coin dispensing devices comprise an inventory of coins of different nominal values provided in so-called coin tubes. Coins deposited in the machine which are not routed directly to a cash box (so-called cash box coins) are sorted into one of the coin tubes according to their nominal values. They are then available for disbursement. For dispensing single coins from a coin tube, there are provided coin dispensing modules, to each of which one or more coin tubes are assigned. In a frequently used construction, a coin dispensing module comprises a rotor disposed horizontally and having an electrical drive. The rotor has, on its upper side, a tappet forming a protrusion. Two coin tubes are assigned to such a coin dispensing module. The coin tubes are designed in a tube-like fashion and are disposed standing vertically above the rotor. Depending on the chosen rotary direction of the rotor, the tappet ejects the lowermost coin of one of the two coin tubes. For further details of these known coin dispensing devices, reference is made to U.S. Pat. No. 5,595,535, the entire contents of which is incorporated herein by reference.

The dispensing of a plurality of coins is usually performed one after the other, so that a plurality of consecutive dispensing cycles, in which one single coin each is dispensed, are required in order to be able to disburse an amount of money consisting of a plurality of coins. Usually, the dispensing of the coins is effected in the order of the nominal values of the coins to be dispensed, starting with the coin having the highest nominal value.

From the international patent application WO 95/14290, the entire contents of which is incorporated herein by reference, a method for operating a coin dispensing device has become known in which special attention is paid to the combination of single coins reflecting a predetermined disbursement amount. To this end, at first all possible combinations of coins are determined which resemble the predetermined disbursement amount. The predetermined disbursement amount usually relates to a given remaining credit, which is to be paid out in coins for example after having sold a certain article. After having determined the possible combinations of coins, an evaluation of each of the combinations is performed. The evaluation accounts for the number of coins of each nominal value currently available in the inventory. Thereby, a well-balanced supply inventory of coins of different nominal values is accomplished. The dispensing of the coins themselves is effected according to the combination with the highest evaluation in a manner which is known as such.

A coin dispensing device differing from the frequently used way of construction described in the beginning has become known from the German patent application DE 103 22 105 A1, the entire contents of which is incorporated herein by reference. In this known coin dispensing device, a plurality of coin tubes is disposed standing vertically on a base plate. To each coin tube, a horizontally movable slider is assigned, which can eject the lowermost coin of the coin tube assigned thereto. In order to drive the slider, a common drive plate is provided, which itself is slidable with respect to the sliders and with respect to the base plate. Further, each slider is equipped with a coupling mechanism which can establish an engagement between the slider and the drive plate. In this manner, by means of the motion of the drive plate, all sliders coupled to the drive plate can simultaneously dispense one coin each.

BRIEF SUMMARY OF THE INVENTION

Based on the above, it is an object of the invention to provide a method for operating a coin dispensing device, which can disburse a predetermined amount of money in shorter time using a robust and simple coin dispensing device. A further object of the invention is to provide a method for operating a coin dispensing device which is less error-prone and prolongs the lifetime of the coin dispensing device. A further object of the invention is to provide a coin dispensing device which can carry out the inventive method.

The method serves to operate a coin dispensing device having a plurality of coin dispensing modules, wherein at least one coin tube for holding coins of a predetermined nominal value is assigned to each dispensing module, each dispensing module is adapted to dispense a coin held in the coin tube assigned to the dispensing module in a dispensing cycle and in response to a control signal, wherein at least two coin tubes assigned to different dispensing modules contain coins of the same nominal value and in one dispensing cycle, a plurality of coin dispensing modules are activated. Each coin dispensing module can dispense exactly one coin in one dispensing cycle. A dispensing cycle can start with receiving a control signal and last until the end of the dispensing process of the coin or, respectively, until receiving a subsequent control signal. Typical dispensing cycles have a duration of for example 0.5 seconds. The control signals may be generated by a control system which controls the disbursement of a predetermined amount of money by determining a combination of coins to be dispensed and by activating the coin dispensing modules in a number of consecutive dispensing cycles in order to dispense the determined combination of coins. According to the invention, it is intended to use a plurality of coin dispensing modules that can be controlled or activated at the same time. Thereby, in a single dispensing cycle, a number of coins equal to the number of coin dispensing modules can be dispensed simultaneously.

By filling at least two coin tubes assigned to different coin dispensing modules with coins having the same nominal values, within a single dispensing cycle a plurality of coins of the same nominal values can be paid out. In particular if a larger number of coins of a certain nominal value are required to be paid out for a predetermined amount of money, the number of necessary dispensing cycles can be reduced significantly by dispensing a plurality of coins of a certain nominal value in parallel. As a consequence, the entire duration of the pay out process is shortened significantly as well. By way of the modular construction with a plurality of coin dispensing modules, which can be identical to one another except for their assignment to optionally different coin tubes, the production of the coin dispensing device can be economized. If desired, one can fall back on well-tried and established components for the coin dispensing modules and the coin tubes.

According to an aspect, in order to disburse a predetermined amount of money, a combination of coins is chosen such that the disbursement of money is performed in the smallest possible number of dispensing cycles. For example, an evaluation of all possible coin combinations for paying out the predetermined amount of money can be performed which is based on the number of coin dispensing cycles required. Thereby, an especially short pay out time can be accomplished. By taking into account further evaluation criteria, such as for example the overall number of coins to be dispensed for the predetermined amount of money, the chosen coin combination can be tailored to further specifications.

According to an aspect, coin tubes containing coins of the same nominal value are kept at approximately similar fill levels. Thereby, a balanced working load of coin tubes and coin dispensing modules assigned thereto is achieved, which may positively influence their lifetime. When activating the coin dispensing modules, the fill levels of the related coin tubes may be taken into account.

As a rule, the fill level of the individual coin tubes can be monitored in any suitable manner. The easiest thing to do is to fill the coin tubes to a defined level by a service technician from time to time. Thereafter, it is kept track of the fill levels by continuously registering any depositing and disbursing processes. Such a method is known for example from the German patent application DE 103 22 384 A1, which is incorporated herein by reference in its entirety. In order to achieve a lower error-proneness of the fill level information, it is intended to use fill level sensors. To each coin tube, a fill level sensor is assigned. Different types of fill level sensors for the mentioned purpose are known for example from the European patent EP 0 680 021 B1, which is incorporated herein by reference in its entirety. According to this, simple fill level sensors can be implemented as switches. It is also possible to use pressure-sensitive sensors which measure the weight of a column of coins, or inductive sensors. As a further option, optical sensors are known, for example from the German patent application DE 10 2004 034 149 A1, which is incorporated herein by reference in its entirety as well. The application of fill level sensors is also known from U.S. patent application 2004/0226802 A1, which is also incorporated herein by reference in its entirety.

According to a further aspect of the invention, each coin dispensing module comprises a coin dispensing region and the coin dispensing modules are arranged such that the coin dispensing regions of at least two coin dispensing modules are disposed in different heights. The coin dispensing regions can be disposed at the lower ends of the coin tubes assigned thereto, where in the most simple case a slot is disposed through which the coins are ejected. By means of the arrangement of at least two coin dispensing modules in different heights a conflict-free operation of the coin dispensing modules is achieved even if a plurality of coin dispensing modules are activated at the same time, as envisioned by the invention. In particular, two coins of different coin dispensing modules are in a very simple manner prevented from hitting each other and from getting jammed or seized in the coin dispensing device when being dispensed.

According to an aspect, the coin dispensing modules can be operated independently of each other and, if a malfunction occurs in a coin dispensing module, the coin dispensing device can be operated with the remaining coin dispensing modules. By means of the storage of coins of the same nominal value in different coin dispensing modules, the method can be carried out without significant limitations even if individual coin dispensing modules do not work properly. This increases the reliability of operation of the device essentially. In particular, if a malfunction of a coin dispensing module is detected during a disbursement process, it is intended to effect the disbursement from a corresponding coin tube of another coin dispensing module. Thereby, even if a malfunction is detected during a disbursement process, the predetermined amount of money can be paid out with coins of the specific nominal value originally intended to be paid out.

According to an aspect, at least two coin tubes assigned to different coin dispensing modules contain coins of the highest nominal value which is scheduled for disbursement. This aspect is especially advantageous when relatively large amounts of money have to be paid out, because at least two coins of the highest nominal value scheduled for disbursement can be dispensed at a time. This helps to reduce the duration of the pay out process.

According to an aspect, each coin dispensing module comprises a coin tube that contains coins of the highest nominal value which is scheduled for disbursement. Thus, a maximum number of coins that can be dispensed at a time, which number is determined by the total number of coin dispensing modules, can be made up entirely of coins of the highest nominal value. Therefore, even large amounts of money can be disbursed very quickly.

According to an aspect, two coin tubes are assigned to each coin dispensing module. Hence, each coin dispensing module can be designed in an especially compact and well-tested manner. Such coin dispensing modules are known for example from U.S. Pat. No. 5,595,535, the entire contents of which is incorporated herein by reference.

According to a further aspect, a total of three coin dispensing modules are provided. As a consequence, in one dispensing cycle, three coins can be dispensed at a time. In combination with coin dispensing modules each having two coin tubes assigned thereto, the coin dispensing device features a total of six coin tubes. In practice, this dimensioning has proven to be especially advisable.

The method serves to operate a coin dispensing device, the coin dispensing device having a plurality of dispensing modules, each dispensing module comprising a dedicated drive mechanism, wherein two coin tubes for holding coins are assigned to each dispensing module, each dispensing module being adapted to dispense a coin held in a coin tube assigned to the dispensing module in a dispensing cycle and in response to a control signal, wherein in one dispensing cycle, a plurality of coin dispensing modules are activated. Thus, the method can make use of well-tried coin dispensing devices which are known for example from U.S. Pat. No. 5,595,535, the entire contents of which is incorporated herein by reference. By means of the simultaneous activation of a plurality of such coin dispensing devices, in one dispensing cycle, a plurality of coins can be dispensed.

The coin dispensing device has a plurality of coin dispensing modules each comprising a dedicated drive mechanism, a coin dispensing region and two coin tubes for holding coins, wherein the coin dispensing modules can be operated independently of each other and the coin dispensing devices are arranged such that the coin dispensing region of a first coin dispensing module is disposed in a height different from the height of the coin dispensing region of a second coin dispensing module. By means of the dedicated drive mechanisms, the coin dispensing devices can be controlled or activated simultaneously, so that a number of coins corresponding to the number of coin dispensing modules can be dispensed simultaneously. Each coin dispensing module dispenses the coins in a defined coin dispensing region, which is implemented for example as a slot disposed at a lower end of a coin tube assigned to the coin dispensing module. By way of the arrangement of the coin dispensing regions at different heights, coins of different coin dispensing modules are effectively prevented from hitting each other even if they are ejected exactly simultaneously. In general, the several coin dispensing modules deliver the ejected coins to a common coin dispensing tube having limited dimensions. The invention provides for a smooth dispensing of coins even if the coin dispensing modules are disposed in close vicinity of on another.

According to an aspect, three coin dispensing modules are provided, the three coin dispensing modules being arranged about a coin dispensing tube, wherein the coin dispensing region of a central coin dispensing module is disposed in a height different from the height of the other two coin dispensing regions. In this aspect, it is the central coin dispensing module which is disposed higher or lower than the other two coin dispensing modules. Between each two adjacent coin dispensing modules, there is always obtained a height difference.

According to an aspect, at least two coin tubes are adapted for holding coins of the same nominal value. Preferably, these two coin tubes are assigned to different coin dispensing modules. The specific design of the coin tubes for holding coins of a certain nominal value in particular lies in an inner diameter of the coin tubes adapted to the diameter of the coins.

According to an aspect, to each coin dispensing module, there is assigned a coin tube adapted for holding coins of the highest nominal value which is scheduled for disbursement. Thus, a number of coins of the highest nominal value corresponding to the number of coin dispensing modules can be dispensed simultaneously, so that larger amounts of money can be paid out very quickly as well.

BRIEF DESCRIPTION OF THE DRAWINGS

The invention is hereinafter described in greater detail by means of a specific embodiment illustrated in two figures.

DETAILED DESCRIPTION OF THE INVENTION

Figure 1:
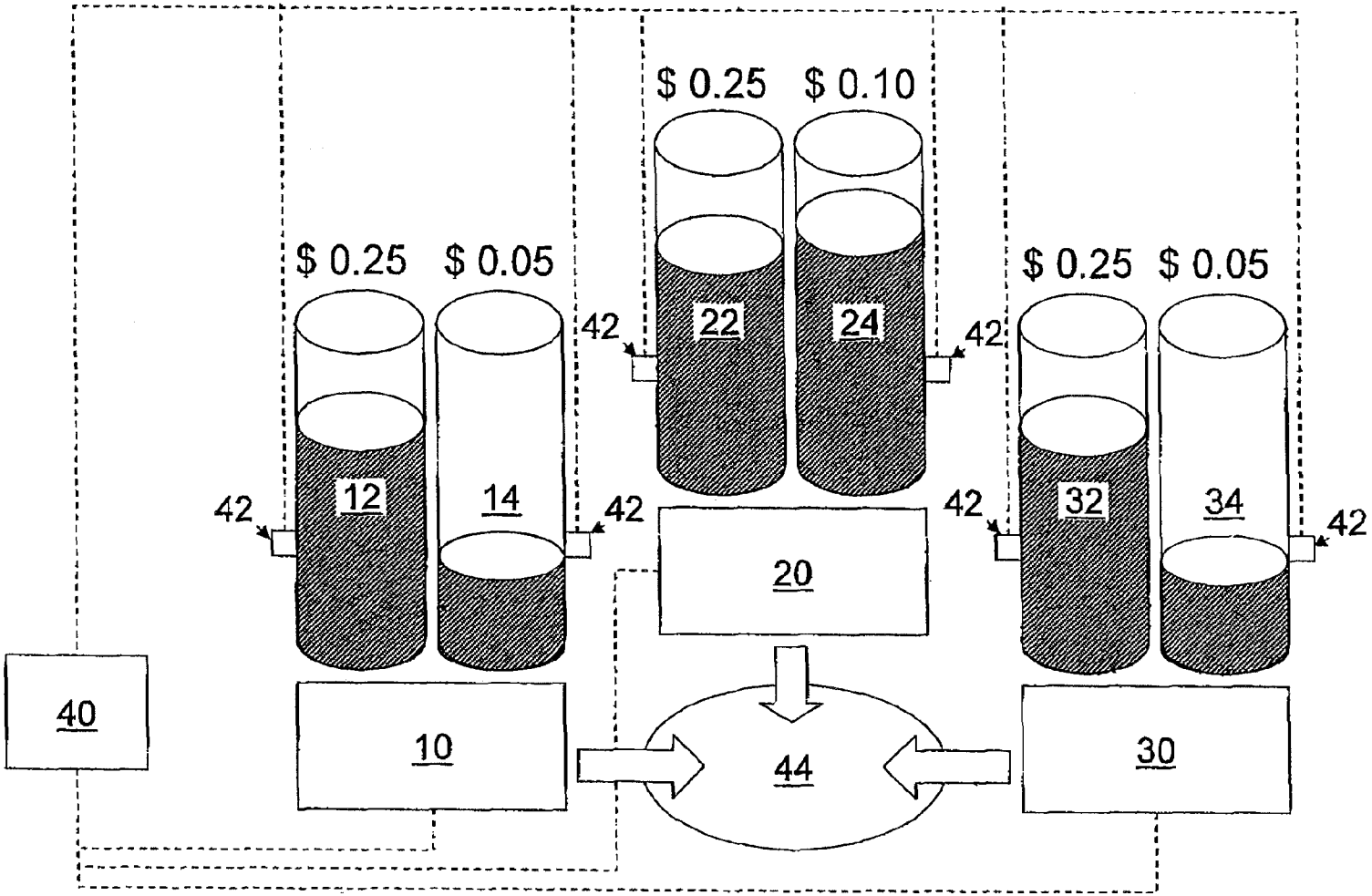
FIG. 1 shows a schematic illustration of an inventive coin dispensing device.

While this invention may be embodied in many different forms, there are described in detail herein a specific preferred embodiment of the invention. This description is an exemplification of the principles of the invention and is not intended to limit the invention to the particular embodiment illustrated An inventive method shall be exemplified by means of FIG. 1. In the figure, there are shown schematically three coin dispensing modules 10, 20, 30. To each of these coin dispensing modules, two coin tubes 12 and 14, 22 and 24 or 32 and 34, respectively, are assigned. Each coin tube contains a certain number of coins, which are indicated by the hatched pillars. The three coin tubes 12, 22 and 32 are equipped with coins of a nominal value of $0.25 and are each assigned to one of the three coin dispensing modules. Consequently, each of the three coin dispensing modules 10, 20, 30 can dispense coins of this nominal value, which is the highest nominal value scheduled for disbursement. The second coin tube 14 of the coin dispensing module 10 and the second coin tube 34 of the coin dispensing module 30 are equipped with coins of a nominal value of $0.05. In the second coin tube 24 of the coin dispensing module 20, coins of a nominal value of $0.10 are disposed. To each of the six coin tubes, a fill level sensor 42 is assigned. As indicated by the three arrows, the three coin dispensing modules deliver the ejected coins to a common coin dispensing tube 44.

A control system 40 is connected to the six fill level sensors 42 and to the three coin dispensing modules 10, 20, 30. The connections are illustrated by a dashed line each. Thus, the control system 40 can monitor the fill levels of the coin tubes by means of the fill level sensors. It is also possible to assign a plurality of fill level sensors to each coin tube in order to achieve more precise information on the fill levels. Through the connections between the control systems 40 and the coin dispensing modules 10, 20, 30 the control system 40 directs control signals to the coin dispensing modules 10, 20, 30.

In order to disburse a certain amount of money, the control system 40 at first determines the desired combination of coins to be paid out. The preferred combination is chosen such that the disbursement is performed in a number of dispensing cycles as small as possible.

With the arrangement shown having three coin dispensing modules, in each dispensing cycle three coins can be dispensed.

After having determined the desired combination of coins, the control system 40 generates the corresponding control signals in a required number of consecutive dispensing cycles. In response to the control signals, the coin dispensing modules 10, 20, 30 dispense the corresponding coins from the coin tubes 12, 14, 22, 24, 32 and 34.

From FIG. 1 it can be seen that coin tubes equipped with coins of the same nominal value have approximately equal fill levels. For example, the coin tubes 12, 22, 32 equipped with 25 cent coins are all filled to approximately two thirds. The two coin tubes 14 and 34, which are equipped with 5 cent coins, are both filled to approximately one fourth. These balanced fill levels, which are maintained by a balanced dispensing of coins from the coin tubes and a balanced depositing of coins into the coin tubes under control of the control system 40, help to achieve a balanced work load of the different coin dispensing modules and can therefore foster a prolonged lifetime of the coin dispensing device.

By way of a disbursement example, the advantages of the inventive method over prior art methods shall be illustrated. The example relates to a coin dispensing device used in a vending machine, in which a customer has deposited a credit of $5.00. Thereafter, the customer buys a drink at a price of $1.25. His remaining credit amounts to $3.75 and must be disbursed by means of the coin dispensing device. The nominal value of the coins with the highest nominal value scheduled for disbursement is 25 cent. Of this type of coin, 15 pieces need to be dispensed.

When a conventional coin dispensing device is used which dispenses the coins one after the other, that is, only one single coin in each dispensing cycle, fifteen dispensing cycles are required to disburse the change.

In the method according to the invention using the coin dispensing device shown in FIG. 1, the disbursement of fifteen 25 cent coins can be finished in five dispensing cycles, in each of which three coins are dispensed simultaneously. Given a duration of a dispensing cycle of 0.5 s, the time needed to dispense the coins using the conventional coin dispensing device is 15×0.5 seconds=7.5 seconds. In contrast, with the inventive method the disbursement can be performed in 5×0.5 seconds=2.5 seconds. The waiting time until the change is fully dispensed may be extremely inconvenient for the customer. It can be reduced by a factor of three.

Figure 2:
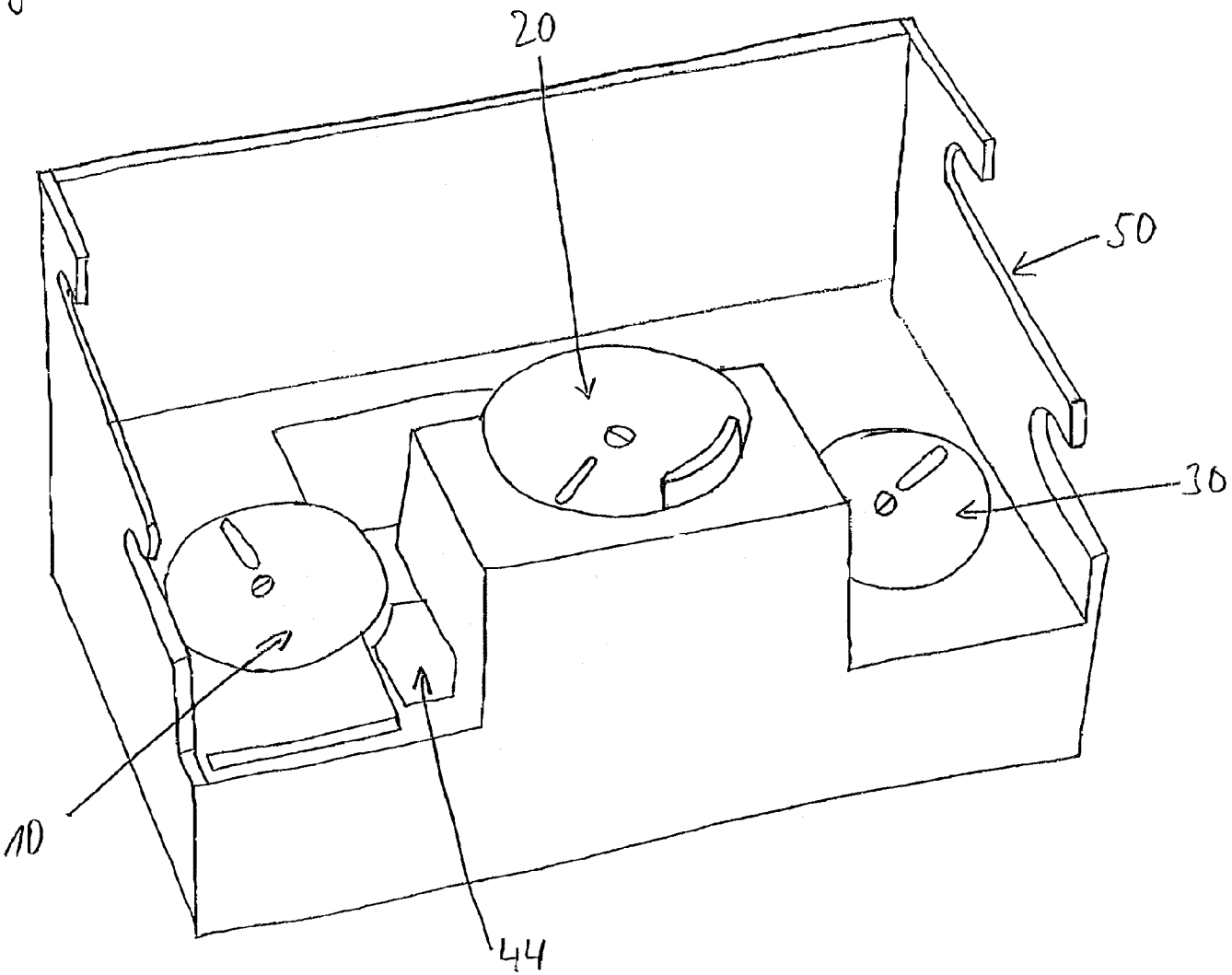
FIG. 2 shows a simplified, perspective view of a coin dispensing device having three coin dispensing modules.

In the simplified, perspective view of FIG. 2, an inventive coin dispensing device is shown. The same reference signs as in FIG. 1 are used. The coin dispensing device comprises a plastic housing 50 which can be installed in a vending machine. Within the housing 50, there are disposed three coin dispensing modules 10, 20, 30 each comprising a rotor visible in the figure. The central coin dispensing module 20 is offset vertically as compared to the two outer coin dispensing modules 10, 30. The coin dispensing modules 10, 20, 30 are each combined with two coin tubes (not shown in the figure) disposed above the rotors of the coin dispensing module. Each of the coin dispensing modules comprises a dedicated drive mechanism, which can effect a rotary motion of the rotor. The coins ejected by the rotary motion of the rotor from the coin tubes assigned to the respective rotor fall into a centrally disposed coin dispensing tube 44.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim 1f such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method for operating a coin dispensing device, comprising the steps of:

providing the coin dispensing device having a plurality of coin dispensing modules, wherein each coin dispensing module comprises a coin dispensing region with a slot , wherein at least one coin tube for holding coins of a predetermined nominal value is assigned to each dispensing module, adapting each dispensing module to dispense a coin held in the coin tube assigned to the dispensing module in a dispensing cycle and in response to a control signal, wherein at least two coin tubes assigned to different dispensing modules contain coins of the same nominal value and in one dispensing cycle, a plurality of coin dispensing modules are being activated simultaneously, wherein coin tubes containing coins of the same nominal value are kept at approximately similar fill levels, and arranging the coin dispensing modules such that the slots of the coin dispensing regions of at least two coin dispensing modules are disposed in different heights, such that coins dispensed simultaneously from different coin dispensing modules are prevented from hitting each other.

2. The method according to claim 1, wherein, in order to disburse a predetermined amount of money, a combination of coins is chosen such that the disbursement of money is performed in the smallest possible number of dispensing cycles.

3. The method according to claim 1, wherein a fill level sensing device is assigned to each coin tube.

4. The method according to claim 1, wherein the coin dispensing modules can be operated independently of each other and, if a malfunction occurs in a coin dispensing module, the coin dispensing device can be operated with the remaining coin dispensing modules.

5. The method according to claim 1, wherein at least two coin tubes assigned to different coin dispensing modules contain coins of the highest nominal value which is scheduled for disbursement.

6. The method according to claim 1, wherein each coin dispensing module comprises a coin tube that contains coins of the highest nominal value which is scheduled for disbursement.

7. The method according to claim 1, wherein two coin tubes are assigned to each coin dispensing module.

8. The method according to claim 1, wherein a total of three coin dispensing modules are provided.

9. A method for operating a coin dispensing device, comprising the steps of:

providing the coin dispensing device having a plurality of dispensing modules, each dispensing module comprising a dedicated drive mechanism, wherein each coin dispensing module comprises a coin dispensing region with a slot , wherein two coin tubes for holding coins are assigned to each dispensing module, adapting each dispensing module to dispense a coin held in a coin tube assigned to the dispensing module in a dispensing cycle and in response to a control signal, wherein in one dispensing cycle, a plurality of coin dispensing modules are being activated simultaneously, and wherein the coin dispensing modules are arranged such that the slots of the coin dispensing regions of at least two coin dispensing modules are disposed in different heights, such that coins dispensed simultaneously from different coin dispensing modules are prevented from hitting each other, wherein at least two coin tubes assigned to different dispensing modules contain coins of the same nominal value, and wherein coin tubes containing coins of the same nominal value are kept at approximately similar fill levels.

10. The method according to claim 9, wherein, in order to disburse a predetermined amount of money, a combination of coins is chosen such that the disbursement of money is performed in the smallest possible number of dispensing cycles.

11. The method according to claim 9, wherein a fill level sensing device is assigned to each coin tube.

12. The method according to claim 9, wherein the coin dispensing modules can be operated independently of each other and, if a malfunction occurs in a coin dispensing module, the coin dispensing device can be operated with the remaining coin dispensing modules.

13. The method according to claim 9, wherein at least two coin tubes assigned to different coin dispensing modules contain coins of the highest nominal value which is scheduled for disbursement.

14. The method according to claim 9, wherein each coin dispensing module comprises a coin tube that contains coins of the highest nominal value which is scheduled for disbursement.

15. The method according to claim 9, wherein a total of three coin dispensing modules are provided.

* * * * *